US009627746B2

(12) United States Patent
Su et al.

(10) Patent No.: US 9,627,746 B2
(45) Date of Patent: Apr. 18, 2017

(54) WIRELESS COMMUNICATION APPARATUS AND ANTENNA SYSTEM THEREOF

(71) Applicant: ASUSTeK COMPUTER INC., Taipei (TW)

(72) Inventors: Saou-Wen Su, Taipei (TW); Fang-Hsien Chu, Taipei (TW); Chih-Chung Lin, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 281 days.

(21) Appl. No.: 14/029,825

(22) Filed: Sep. 18, 2013

(65) Prior Publication Data

US 2014/0111384 A1 Apr. 24, 2014

(30) Foreign Application Priority Data

Oct. 18, 2012 (TW) ..... 101138432 A

(51) Int. Cl.

| | |
|---|---|
| ***H01Q 1/36*** | (2006.01) |
| ***H01Q 1/24*** | (2006.01) |
| ***H01Q 9/04*** | (2006.01) |

(52) U.S. Cl.

CPC ..... *H01Q 1/36* (2013.01); *H01Q 1/243* (2013.01); *H01Q 9/0414* (2013.01); *H01Q 9/0421* (2013.01); *H01Q 9/0471* (2013.01)

(58) Field of Classification Search

CPC ..... H01Q 1/36; H01Q 1/243; H01Q 9/0421; H01Q 9/0471; H01Q 9/0414

See application file for complete search history.

(56) References Cited

U.S. PATENT DOCUMENTS

| | | | | |
|---|---|---|---|---|
| 6,531,985 | B1 * | 3/2003 | Jones et al. | 343/702 |
| 7,782,270 | B2 * | 8/2010 | Chung et al. | 343/846 |
| 2012/0280871 | A1 * | 11/2012 | Shamblin | H01Q 1/243 343/747 |
| 2014/0313098 | A1 * | 10/2014 | Lin | 343/848 |

* cited by examiner

*Primary Examiner* — Graham Smith
*Assistant Examiner* — Noel Maldonado
(74) *Attorney, Agent, or Firm* — CKC & Partners Co., Ltd.

(57) ABSTRACT

A wireless communication apparatus and an antenna system therein are provided. The antenna system includes a grounding portion and an antenna body. The grounding portion includes a ground plane and a conducting element. The conducting element is perpendicular to the ground plane and is connected to the ground plane to provide a first current path. The antenna body includes a main radiating portion and a short circuit portion. The main radiating portion is parallel to the ground plane and provides a second current path. An end of the main radiating portion is electrically connected to a signal source. The short circuit portion is electrically connected between the main radiating portion and the conducting element and provides a third current path. The directions of the first current path, the second current path and the third current path are perpendicular mutually.

12 Claims, 5 Drawing Sheets x-y plane x-y plane x-y plane

WIRELESS COMMUNICATION APPARATUS AND ANTENNA SYSTEM THEREOF

CROSS-REFERENCE TO RELATED APPLICATION

This application claims the priority benefit of Taiwan application serial No. 101138432, filed on Oct. 18, 2012. The entirety of the above-mentioned patent application is hereby incorporated by reference herein and made a part of specification.

BACKGROUND OF THE INVENTION

Field of the Invention

The disclosure relates to a wireless communication apparatus and an antenna system of the wireless communication apparatus.

Description of the Related Art

With the rapid development of the communication technology, the wireless communication apparatus is widely used in daily life, such as a mobile phone, a notebook computer and a tablet computer. The wireless communication apparatus with a metal housing is popular in the market due to better appearance and better texture characteristics.

In general, the shielding effect of metal housing affects the antenna system in transmitting and receiving signals. Therefore, in a conventional wireless communication apparatus, the housing close to the antenna system is mostly made of non-metallic material in order to avoid the impedance bandwidth and the radiation characteristics are influenced by the conductive material nearby.

Therefore, dead zones and signal attenuation problems arise if the conventional antenna system is configured in a full-metal housing.

BRIEF SUMMARY OF THE INVENTION

The antenna system includes a grounding portion and an antenna body. The grounding portion includes a ground plane and a conducting element. The conducting element is perpendicular to the ground plane and is connected to the ground plane to provide a first current path. The antenna body includes a main radiating portion and a short circuit portion. The main radiating portion is parallel to the ground plane and provides a second current path. An end of the main radiating portion is electrically connected to a signal source. The short circuit portion is electrically connected between the main radiating portion and the conducting element and provides a third current path, wherein the short circuit portion and the main radiating portion are at a same plane. The directions of the first current path, the second current path and the third current path are perpendicular mutually.

The wireless communication apparatus disclosed herein includes a metal housing and an antenna system. The antenna system is disposed in the metal housing and includes a ground plane, a conducting element, a feed-in portion, a main radiating portion and a short circuit portion. The conducting element is perpendicular to the ground plane. The feed-in portion is electrically connected to the conducting element and a negative feed-in point. The main radiating portion is parallel to the ground plane and includes a first end and a second end; the first end of the main radiating portion is adjacent to the feed-in portion and electrically connected to a positive feed-in point. The short circuit portion is electrically connected between the main radiating portion and the conducting element, the short circuit portion and the main radiating portion are disposed at a same plane.

To sum up, the magnitude of the horizontal component of the radiation pattern is similar to that of the vertical component of the radiation pattern in the antenna system described herein, so the antenna system is suitable for a wireless LAN environment with multiple paths. In this way, the antenna system in a multipath environment may still send and receive signals via other radiation wave paths to maintain the quality of the communication, even it is shielded by a metal plate (such as a metal housing) nearby.

DETAILED DESCRIPTION OF THE EMBODIMENTS

These and other features, aspects, and advantages of the present invention will become better understood with regard to the following description, appended claims, and accompanying drawings. Persons having ordinary skill in the art may make various modifications and changes without departing from the scope and spirit of the invention.

These and other features, aspects, and advantages of the present invention will become better understood with regard to the following description, appended claims, and accompanying drawings. Persons having ordinary skill in the art may make various modifications and changes without departing from the scope and spirit of the invention.

These and other features, aspects, and advantages of the present invention will become better understood with regard to the following description, appended claims, and accompanying drawings. Persons having ordinary skill in the art may make various modifications and changes without departing from the scope and spirit of the invention.

The type of the disclosure is a wireless communication device such as a tablet PC, notebook, mobile phone, etc. For easy description, the following content is described as tablet PC, but not limited herein.

"The first", "the second" and so on are not used to limit the order, they are also not used to limit the invention, and they are only used to distinguish components or operations with same technical terms.

Figure 1:
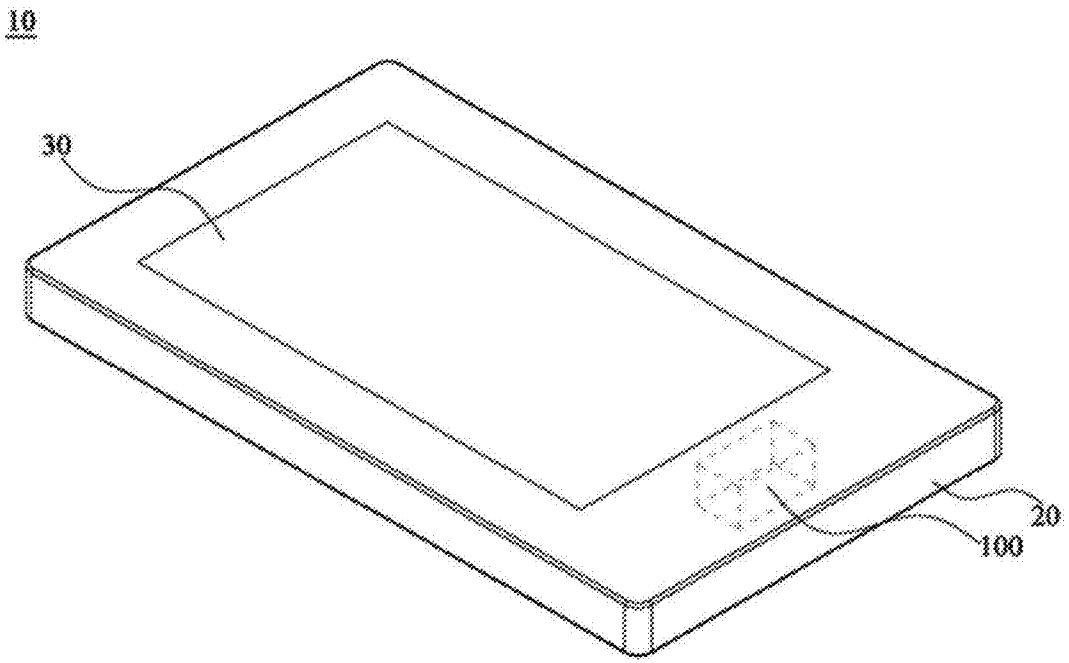
FIG. 1 is a schematic diagram showing a wireless communication apparatus in an embodiment.

FIG. 1 is a schematic diagram showing a wireless communication apparatus in an embodiment. A wireless communication apparatus 10 includes a metal housing 20, a display screen 30 and an antenna system 100. The antenna system may be a patch antenna disposed in the metal housing 20. In an embodiment, the antenna system 100 is not electrically connected to the metal housing 20 to avoid the instability of the antenna system 100 due to metal interference such as the metal housing 20 or metal products from outside world. It should be noted that, although the antenna system 100 is disposed around the display screen 30 in FIG. 1, the antenna system 100 can be configured in an position of the wireless communication device 10, which is not limited to the FIG. 1.

Figure 2A:
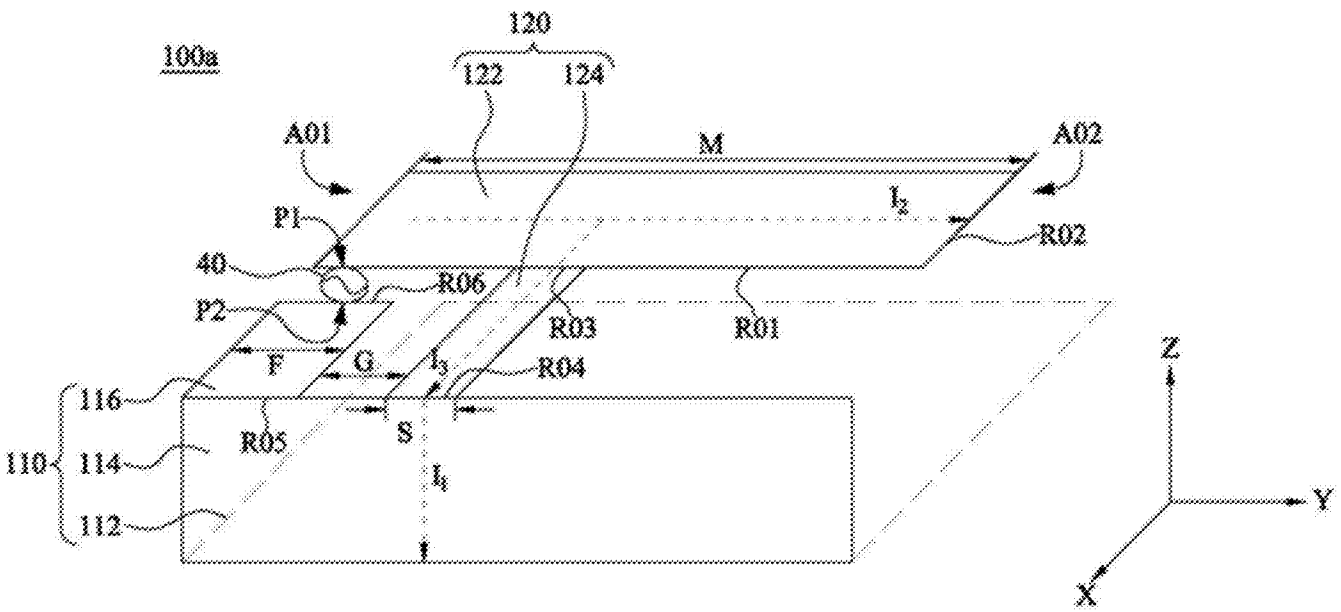
FIG. 2*a* and FIG. 2*b* are schematic diagrams showing an antenna system in an embodiment.

FIG. 2*a* is as schematic diagram showing, an antenna system 100*a* in an embodiment. As shown in FIG. 2*a*, the antenna system 100*a* includes a grounding portion 110 and an antenna body 120. The grounding portion 110 includes a ground plane 112 and a conducting element 114. The conducting element 114 is perpendicular to the ground plane 112 and connected to the ground plane 112. The antenna body 120 includes a main radiating portion 122 and a short circuit portion 124. The main radiating portion 122 is perpendicular to the conducting element 114 and parallel to the ground plane 112. Therefore, the main radiating portion 122 and the ground plane 112 are defined as the antenna plane and the ground plane, respectively. The main radiator portion 122 has a first end A01 and a second end A02. The first end A01 and the second end A02 are opposite to each other, and the first end A01 is electrically connected to a signal source 40. The short circuit portion 124 is electrically connected between the main radiating portion 122 and the conductive element 114, thus the main radiating portion 122 is electrically connected to the ground plane 112 via the short circuit portion 124 and the conductive element 114.

For example, taking a coordinate axes x, y, z as the space basis, the ground plane 112 and the main radiating, portion 122 may be parallel to the x-y plane. The main radiating portion 122 may be a rectangular plane including a first side R01 and a second side R02. The first side R01 is a line segment on the y-axis direction and the second side R02 is a line segment on the x-axis direction. The first side R01 is adjacent to the second side R02, and the length of the first side R01 is greater than the length of the second side R02. The short circuit portion 124 may be a rectangular plane including a first side R03 and a second side R04, and both the first side R03 and the second side R04 may be line segments on the y-axis direction. The first side R03 and the second side R04 of the short-circuit portion 124 are opposite to each other. The first side R03 of the short circuit unit 124 is connected to the first side R01 of the main radiating portion 122, and the second side R04 of the short circuit portion 124 is connected to the conducting element 114. The length of the first side R03 of the short circuit unit 124 is less than the length of the first side R01 of the main radiating portion 122. The conducting element 114 may be parallel to the y-z plane. One side of the conducting element 114 may be a line segment on the y-axis direction and is connected to the second side R04 of the short circuit portion 124, and the opposite side of the conducting element 114 may also be a line segment on the y-axis direction and is connected to the ground plane 112.

Referring again to the FIG. 2*a*, the signal source 40 may provide an excitation current to the antenna system 100*a*, meanwhile the amount and distribution of the excitation current relates to the length, width and size of the components in the antenna system. In the embodiment, when the signal is fed through the signal source 40 (for example, when transmitting the radio frequency signals), a second excitation current may flow through the main radiating portion 122 along a second current path I2, a third trigger current may flow through the short circuit portion 124 along a third current path I3, and the first excitation current may flow into the conducting element 114 along the first current path I1 following the third excitation current. The directions of the first current path I1, the second current path I2 and the third current path I3 are perpendicular mutually, so that the magnitude of the horizontal component of the radiation pattern is similar to that of the vertical component of the radiation pattern.

Figure 3A:
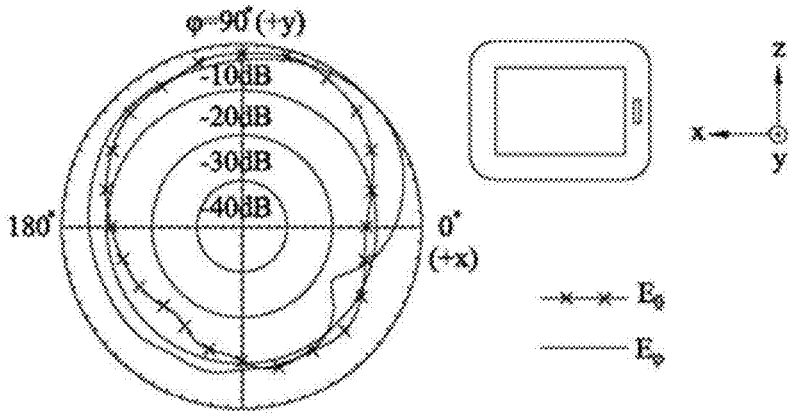
FIG. 3*a* is a radiation pattern diagram showing an antenna system in the spatial direction angle θ and ψ in a first embodiment.
Figure 3B:
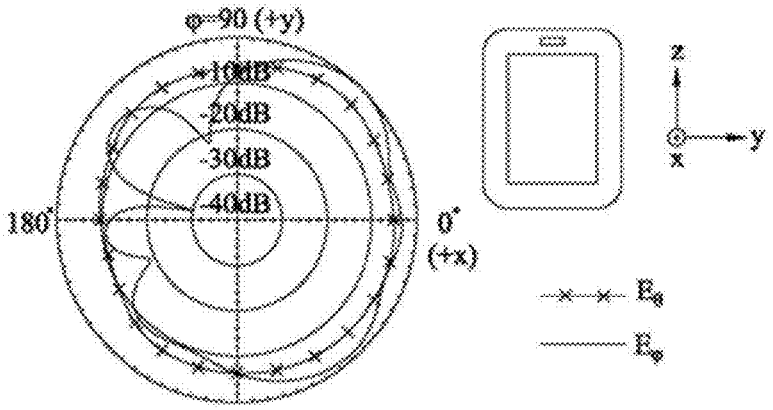
FIG. 3*b* is a radiation pattern diagram showing an antenna system in the spatial direction angle θ and ψ in a second embodiment.
Figure 3C:
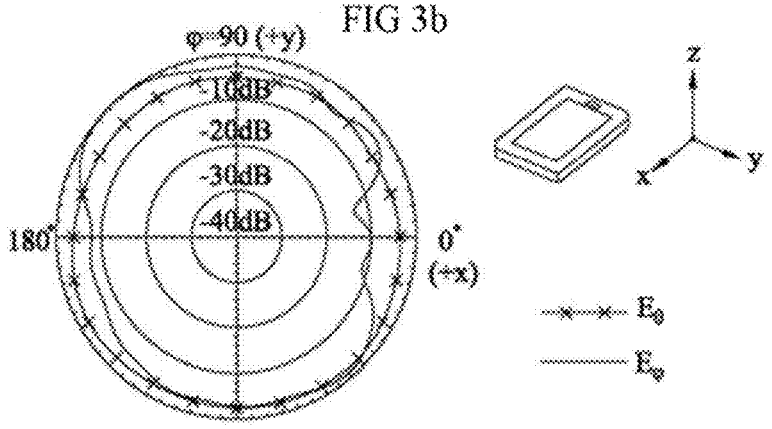
FIG. 3*c* is a radiation pattern diagram showing an antenna system in the spatial direction angle θ and ψ in a third embodiment.

FIG. 3*a*, FIG. 3*b*, FIG. 3*c* respectively shows the radiation pattern Eθ (the vertical component of the radiation pattern) and the radiation pattern E ψ (the horizontal component of the radiation pattern) of the antenna system 100*a* when the wireless communication device 10 is in transverse, up-right and flat states, respectively according to experimental analyses. As shown in the figures, no matter which the wireless communication device 10 is in transverse, up-right or the flat state, the radiation pattern Eθ is approximate to the radiation pattern E ψ. Therefore, the radiation pattern Eθ maintains in a certain level of gain (such as a gain of more than −15 dB) regardless of the angle of the wireless communications device 10.

Figure 3D:
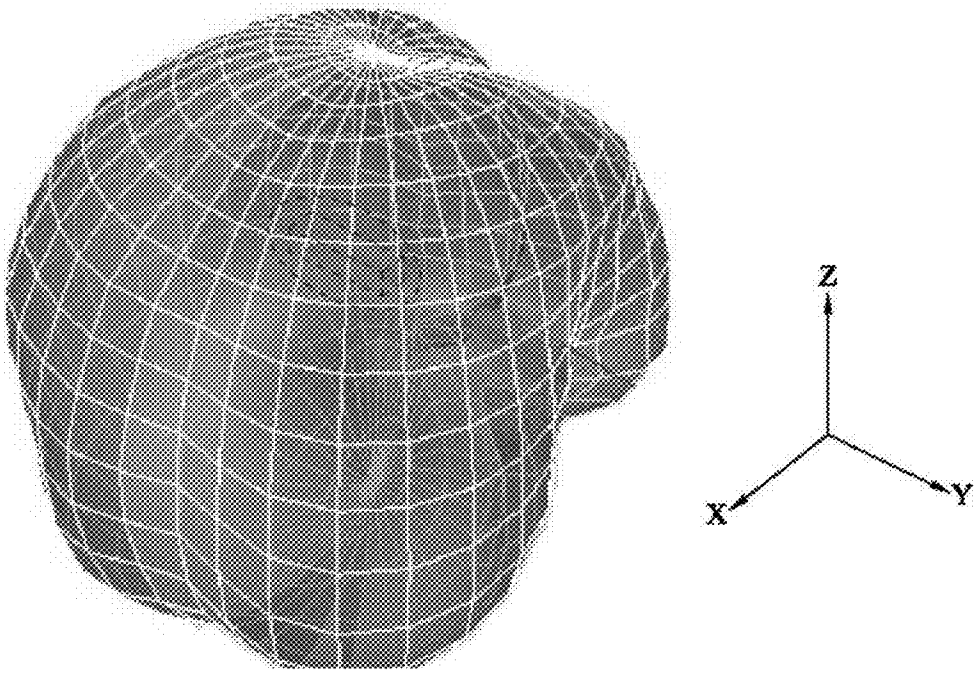
FIG. 3*d* is a three-dimensional radiation pattern diagram showing an antenna system in an embodiment

In the embodiment, the radiation pattern of the antenna system 100*a* may be as shown in FIG. 3*d*. The overall antenna efficiency of the antenna system 100*a* may be about 78%, and the power gain is about 4.5 dBi.

From the radiation pattern described above, the antenna system 100*a* receives the radiation wave at the vertical direction from all angles by the configuration in the above embodiment. Consequently, in a multipath wireless regional area networks (WRAN) environment, the antenna system 100*a* can still send and receive signals to maintain the quality of the communication even it is disposed in the metal housing 20.

Referring again to the FIG. 2*a*, the grounding portion 110 further includes a feed-in portion 116. The feed-in portion 116 includes a signal source 40 having a positive feed-in point P1 and a negative feed-in point P2. The feed-in portion 116 is perpendicular to the conducting element 114 and parallel to the ground plane 112. The feed-in portion 116 includes a first side R05 and a second side R06. The first side R05 is connected to the conducting element 114, and the second side R06 is adjacent to the first end A01 of the main radiating portion 122. Thus, the feed-in portion 116 electrically connects to the negative feed-in point P2 of the signal source 40, and the first end A01 of the main radiating portion 122 electrically connects to the positive feed-in point P1 of the signal source 40.

In some embodiments, the main radiating portion 122 may transmit and receive a radiating wave via the second current path I2. The resonance length of the second current path I2 is a quarter of the wavelength of the radiation wave, and the frequency of the radiation wave may be between 2400 to 2484 MHz conforming to the IEEE 802.11b/g protocol.

It should be noted, without departing from the spirit of the present disclosure, the impedance matching and the resonant mode of the antenna system 100*a* can be reached by adjusting the length, the width and the relative relationships among the elements of the antenna system 100*a*, and the significant effect will be illustrated in the following embodiment.

As shown in FIG. 2*a*, in some embodiments, the length M of the main radiating portion 122 corresponds to the resonance length of the second current path I2. Therefore, the longer the length M is, the longer the resonance length of the second current path I2 is. As a result, the length M of the main radiator portion 122 is changed for adjusting the impedance matching and the resonant mode of the antenna system 100*a* (for example, the longer the length M is, the lower the frequency of resonance mode is). However, a person having ordinary skills in the art should understand, the ground plane exists below the antenna plane of the flat-plate antenna. Thus, when the Length M of the main radiating portion 122 is adjusted, it should be avoided that the orthographic projection of the antenna body 120 on the ground plane 112 is beyond the ground plane 112.

Since the capacitive coupling effect is generated between the second side R06 of the feed-in portion 116 and the main radiating portion 122, the length F of the second side R06 can be changed for adjusting the impedance matching and the resonant mode of the antenna system 100*a* (for example, the larger of the length F is, the lower frequency of the resonance mode is). Further, the coupling effect is also generated between the feed-in portion 116 and the short circuit portion 124, and thus the gap G between the feed-in portion 116 and the short circuit portion 124 can also be changed for adjusting the impedance matching and the resonant mode of the antenna system 100*a* (for example, the larger the gap G is, the lower the frequency of the resonant modes is).

In other embodiments, the main radiation 122 and the short circuit portion 124 is disposed at the same plane and forms the antenna plane of the flat-plate antenna 122. In addition, the width S of the short circuit portion 124 can also be changed for adjusting impedance matching and the resonance mode of the antenna system 100*a* (for example, the wider the width S is, the lower the frequency of the resonant modes is).

Figure 2B:
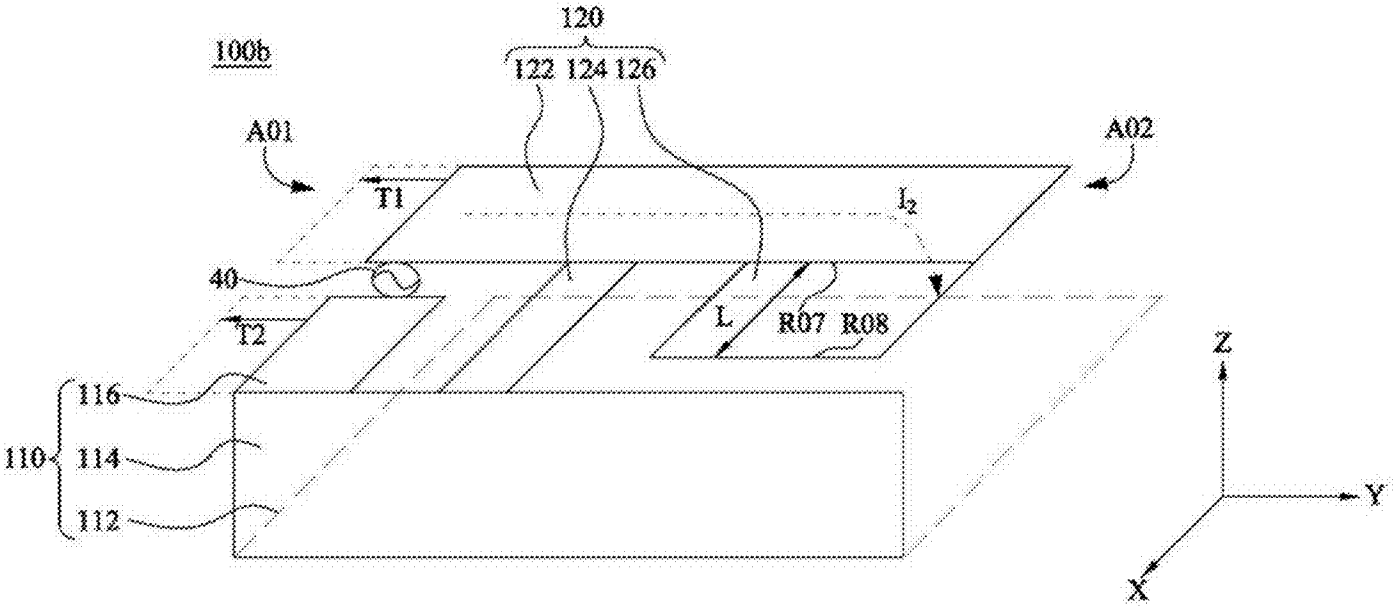

Referring to the FIG. 2*b*, FIG. 2*b* is a schematic diagram showing an antenna system 100*b* in another embodiment. In the present embodiment, the antenna body 120 further includes an extending portion 126. The extending portion 126 has a first side R07 and a second side R08. The first side R07 and the second side R08 are opposite to each other. The first side R07 is connected to the second end A02 of the main radiating portion 122, and the second side R08 is adjacent to the conducting element 114. In the embodiment, since the capacitive coupling effect may generate between the second side R08 and the conducting element 114, the spacing L between the first side R07 and the second side R08 may be changed for adjusting the impedance matching and resonance mode of the antenna system 100*b* (for example, the frequency of the resonant modes is lower when the spacing L is bigger). In addition, the spacing L may also be changed for adjusting the resonance length of the second current path I2 (for example, the resonance length of the second current path I2 is longer when the spacing L is bigger). It should be noted that, in some embodiments, the shape of the extending portion 126 and the connection position in which the extending portion 126 is connected with the main radiating portion 122 can be adjusted according to practical requirements (for example, the extending portion 126 is connected to the other side of the min radiating portion which is not limited herein.

Moreover, in some embodiments, the antenna system 100*b* can simultaneously receive more than two radiation wave at different frequency ranges, for example, frequencies between 2400-2484 MHz and 5150-5350 MHz and conforming to IEEE 802.11b/g protocol and 802.11a communication protocol, respectively. In these embodiments, the frequency of the high-order mode of the antenna system 100*b* is reduced by extending the feed-in portion 116 back towards the short circuit portion 124 (as indicated by arrow T1), and/or by extending the main radiating portion 122 back towards the second end A02 of the main radiating portion 122 (as indicated by arrow T2), so that the antenna system 100*b* receives more than two radiation waves with different frequency ranges. It should be noted that, the frequency of the high-order mode of the antenna system 100*b* is also reduced by adjusting the length, the width and the relative relationships of the each element in the antenna system 100*b*, which is not limited to the above embodiment.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An antenna system, comprising:

a grounding portion, including:

a ground plane;

a conducting element perpendicular to the ground plane and connected to the ground plane, and providing a first current path; and a feed-in portion electrically connected to the conducting element, wherein the feed-in portion is perpendicular to the conducting element; and an antenna body, including:

a main radiating portion parallel to the ground plane and providing a second current path, wherein an end of the main radiating portion is electrically connected to a signal source;

a short circuit portion electrically connected between the main radiating portion and the conducting element and providing a third current path, wherein the short circuit portion and the main radiating portion are at a same plane; and an extending portion parallel to the main radiating portion and extended from the main radiating portion toward the conducting element, wherein the extending portion is perpendicular to the conducting element;

wherein the first current path, the second current path and the third current path are perpendicular mutually, and wherein all of the signal source, the short circuit portion, and the extending portion are connected to a same side of the main radiating portion.

2. The antenna system according to claim 1, wherein the grounding portion includes a feed-in portion electrically connected to the conducting element, wherein the feed-in portion is electrically connected to a negative feed-in point of the signal source, and the main radiating portion is electrically connected to a positive feed-in point of the signal source.

3. The antenna system according to claim 1, wherein the feed-in portion extends back towards the short circuit portion, and an end of the main radiating portion which is electrically connected to the signal source extends back towards the other end of the main radiating portion to make the antenna system receive more than two radiation waves with different frequency ranges.

4. The antenna system according to claim 1, wherein the antenna body further includes an extending part and one side of the extending part is adjacent to the conducting element.

5. A wireless communication apparatus, comprising:

a metal housing; and an antenna system, disposed in the metal housing, including:

a ground plane;

a conducting element perpendicular to the ground plane;

a feed-in portion electrically connected to the conducting element and a negative feed-in point, wherein the feed-in portion is perpendicular to the conducting element;

a main radiating portion parallel to the ground plane, wherein an end of the main radiating portion is adjacent to the feed-in portion and electrically connected to a positive feed-in point;

a short circuit portion electrically connected to the main radiating portion and the conducting element, wherein the short circuit portion and the main radiating portion are disposed at the same plane; and an extending portion parallel to the main radiating portion and extended from the main radiating portion toward the conducting element, wherein the extending portion is perpendicular to the conduction element, and wherein a signal source, the short circuit portion, and the extending portion are connected to a same side of the main radiating portion.

6. The wireless communication apparatus according to the claim 5, wherein the grounding plane is not electrically connected to the metal housing.

7. The wireless communication apparatus according to the claim 5, wherein the conducting element provides a first current path, the main radiating portion provides a second current path, the short circuit portion provides a third current path, and directions of the three current paths are perpendicular mutually.

8. The wireless communication apparatus according to the claim 5, wherein the feed-in portion extends back towards the short circuit portion, and the main radiating portion extends back towards a second end of the main radiating portion to make the antenna system receive more than two radiation waves with different frequency ranges.

9. The wireless communication apparatus according to the claim 5, the antenna body further includes an extending part, and one side of the extending part is adjacent to the conducting element.

10. The antenna system according to claim 1, wherein the extending portion is extended from another end of the main radiating portion opposite to the end of the main radiating portion electrically connected to the signal source.

11. The antenna system according to claim 1, wherein the second current path is extended to the extending portion.

12. The wireless communication apparatus according to the claim 5, wherein the extending portion is extended from another end of the main radiating portion opposite to the end of the main radiating portion electrically connected to the signal source.

* * * * *